US007946825B2

(12) United States Patent
Tudor

(10) Patent No.: US 7,946,825 B2
(45) Date of Patent: May 24, 2011

(54) TURBOFAN GAS TURBINE ENGINE FAN BLADE AND A TURBOFAN GAS TURBINE FAN ROTOR ARRANGEMENT

(75) Inventor: David J Tudor, Derby (GB)

(73) Assignee: Rolls-Royce, plc, London (GB)

( * ) Notice: Subject to any disclaimer, the term of this patent is extended or adjusted under 35 U.S.C. 154(b) by 19 days.

(21) Appl. No.: 12/585,777

(22) Filed: Sep. 24, 2009

(65) Prior Publication Data

US 2010/0014984 A1 Jan. 21, 2010

Related U.S. Application Data

(63) Continuation of application No. 11/446,379, filed on Jun. 5, 2006, now abandoned.

(30) Foreign Application Priority Data

Jun. 29, 2005 (GB) ..... 0513187.5

(51) Int. Cl.
*F01D 5/20* (2006.01)

(52) U.S. Cl. ..... 416/223 A; 416/235

(58) Field of Classification Search ..... 415/173.1; 416/223 A, 228, 235

See application file for complete search history.

(56) References Cited

U.S. PATENT DOCUMENTS

| | | | |
|---|---|---|---|
| 889,319 | A | 6/1908 | Parsons et al. |
| 3,993,414 | A | 11/1976 | Meauze et al. |
| 4,118,147 | A | 10/1978 | Ellis |
| 4,274,806 | A | 6/1981 | Gallardo |
| 5,295,789 | A | 3/1994 | Daguet |
| 5,456,576 | A | 10/1995 | Lyon |
| 5,476,363 | A | 12/1995 | Freling et al. |
| 5,624,234 | A | 4/1997 | Neely et al. |
| 6,358,012 | B1 | 3/2002 | Staubach |
| 6,382,905 | B1 | 5/2002 | Czachor et al. |
| 6,739,835 | B2 | 5/2004 | Kim |
| 6,832,890 | B2 | 12/2004 | Booth |
| 2002/0090301 | A1 | 7/2002 | Lee et al. |
| 2003/0059309 | A1 | 3/2003 | Szucs et al. |
| 2004/0241003 | A1 * | 12/2004 | Roy et al. ..... 416/236 R |

FOREIGN PATENT DOCUMENTS

| | | | |
|---|---|---|---|
| GB | 531445 | A | 1/1941 |
| GB | 1079606 | A | 8/1967 |
| GB | 2 155 558 | A | 9/1985 |
| WO | WO 91/00212 | A | 1/1991 |

* cited by examiner

*Primary Examiner* — Richard Edgar
(74) *Attorney, Agent, or Firm* — Oliff & Berridge, PLC

(57) ABSTRACT

A fan blade is provided having a root portion and an aerofoil portion that has a leading edge, a trailing edge and a tip remote from the root portion. A concave pressure surface extends from the leading edge to the trailing edge and a convex suction surface extends from the leading edge to the trailing edge. A portion of the tip of the aerofoil portion between the leading edge and the trailing edge of the aerofoil portion is thinner than the remainder of the tip. The portion of the tip of the aerofoil portion is spaced from the leading edge and is spaced from the trailing edge. The portion of the tip of the aerofoil portion has a recess arranged on the concave pressure surface such that the portion of the tip of the aerofoil portion is thinner than the remainder of the tip.

17 Claims, 2 Drawing Sheets

TURBOFAN GAS TURBINE ENGINE FAN BLADE AND A TURBOFAN GAS TURBINE FAN ROTOR ARRANGEMENT

This is a Continuation of application Ser. No. 11/446,379 filed Jun. 5, 2006, which claims the benefit of British Patent Application No. 0513187.5 filed Jun. 29, 2005. The disclosures of the prior application are hereby incorporated by reference herein in their entirety.

The present invention relates to a blade, and in particular to a fan blade for a turbofan gas turbine engine.

Small tip chord turbofan clapper less fan blades may suffer from vibration where altitude aerodynamic forces lead to excitation of a fan blades natural modes of vibration, e.g. second flap mode, away from coincidence with the harmonics of a fan blades rotational speed, i.e. a non integral vibration. At high fan blade rotational speeds, forward propagating pressure waves normal to passage shock waves are formed in the passages defined circumferentially between the radially outer tips of adjacent fan blades and bounded by the fan casing which provides useful compression of the air flow. However, at altitudes greater than about 40000 ft, 12200 m, and over specific speed ranges, greater than about 1500 $fts^{-1}$, 457 $ms^{-1}$ and fan blades having a tip chord length of less than 300 mm, excitation of natural modes of vibration of the fan blades due to unsteady motion of the shock waves has led to divergent fan blade vibration.

These unsteady pressure waves from the normal to the passage shock propagate in an upstream direction in the passages between the tips of the fan blades in the high Mach No. flow. These unsteady pressure waves are of concern where the pressure waves have short wavelengths approximating to 0.5, 1.5, 2.5 times the chord wise length of the passage between the tips of adjacent fan blades, the passage length extends from the leading edge to the trailing edge of the fan blades. These unsteady pressure waves may provide anti-phase excitation of leading edge motion of adjacent fan blades. If there is a coincidence of the mode shape, e.g. significant leading edge motion of the fan blades within the second flap vibration mode shape, divergent blade vibration is produced, which reduces the life of the fan blades and increases the incidence of mechanical failure, e.g. cracking.

Accordingly the present invention seeks to provide a novel blade, which at least reduces the above problem.

Accordingly the present invention provides a blade comprising a root portion and an aerofoil portion, the aerofoil portion has a leading edge, a trailing edge and a tip remote from the root portion, a concave pressure surface extends from the leading edge to the trailing edge and a convex suction surface extends from the leading edge to the trailing edge, a portion of the tip of the aerofoil portion between the leading edge and the trailing edge of the aerofoil portion is thinner than the remainder of the tip, the portion of the tip of the aerofoil portion is spaced from the leading edge and is spaced from the trailing edge.

Preferably the tip portion of the aerofoil has a recess such that the portion of the tip of the aerofoil portion is thinner than the remainder of the tip.

Preferably the recess is arranged on the concave surface of the aerofoil portion.

Preferably the thickness of the portion of the tip of aerofoil portion reduces to a minimum thickness in the range of 60% to 70% of the thickness of the remainder of the tip.

Preferably the thickness of the portion of the tip of aerofoil portion reduces to a minimum thickness of 66% of the thickness of the remainder of the tip.

Preferably the portion of the tip of the aerofoil extends from a position at about 10% of the chord length from the leading edge to a position at about 90% of the chord length from the leading edge.

Preferably the portion of the tip of the aerofoil extends from a position at about 50 mm from the leading edge to a position at about 26 mm from the trailing edge.

Preferably the portion of the tip of the aerofoil extends about 20 mm from the tip of the aerofoil portion transversely to the chord.

Preferably the blade is a fan blade. Preferably the blade has a tip chord length of less than 300 mm.

A rotor arrangement comprising a rotor and plurality of circumferentially spaced blades extending radially outwardly from the rotor, each blade comprising an aerofoil portion, each aerofoil portion having a leading edge, a trailing edge and a tip remote from the rotor, each aerofoil having a concave pressure surface extending from the leading edge to the trailing edge and a convex suction surface extending from the leading edge to the trailing edge, a portion of the tip of each aerofoil portion between the leading edge and the trailing edge of the aerofoil portion being thinner than the remainder of the tip, the portion of the tip of each aerofoil portion being spaced from the leading edge and being spaced from the trailing edge, a plurality of passages being defined between the blades, the distance between the tips of aerofoils of adjacent blades increasing from a first distance at the leading edge to a maximum distance at the portion of the tip of each aerofoil portion and decreasing to a second distance at the trailing edge.

Preferably the tip portion of each aerofoil portion has a recess such that the portion of the tip of the aerofoil portion is thinner than the remainder of the tip.

Preferably each recess is arranged on the concave surface of the aerofoil portion.

Preferably the thickness of the portion of the tip of each aerofoil portion reduces to a minimum thickness in the range of 60% to 70% of the thickness of the remainder of the tip.

Preferably the thickness of the portion of the tip of each aerofoil portion reduces to a minimum thickness of 66% of the thickness of the remainder of the tip.

Preferably the portion of the tip of each aerofoil portion extends from a position at about 10% of the chord length from the leading edge to a position at about 90% of the chord length from the leading edge.

Preferably the portion of the tip of each aerofoil portion extends from a position at about 50 mm from the leading edge to a position at about 26 mm from the trailing edge.

Preferably the portion of the tip of each aerofoil portion extends about 20 mm from the tip of the aerofoil portion transversely to the chord.

Preferably the blades are fan blades. Preferably the blades have a tip chord length of less than 300 mm.

The present invention will be more fully described by way of example with reference to the accompanying drawings in which.

Figure 1:
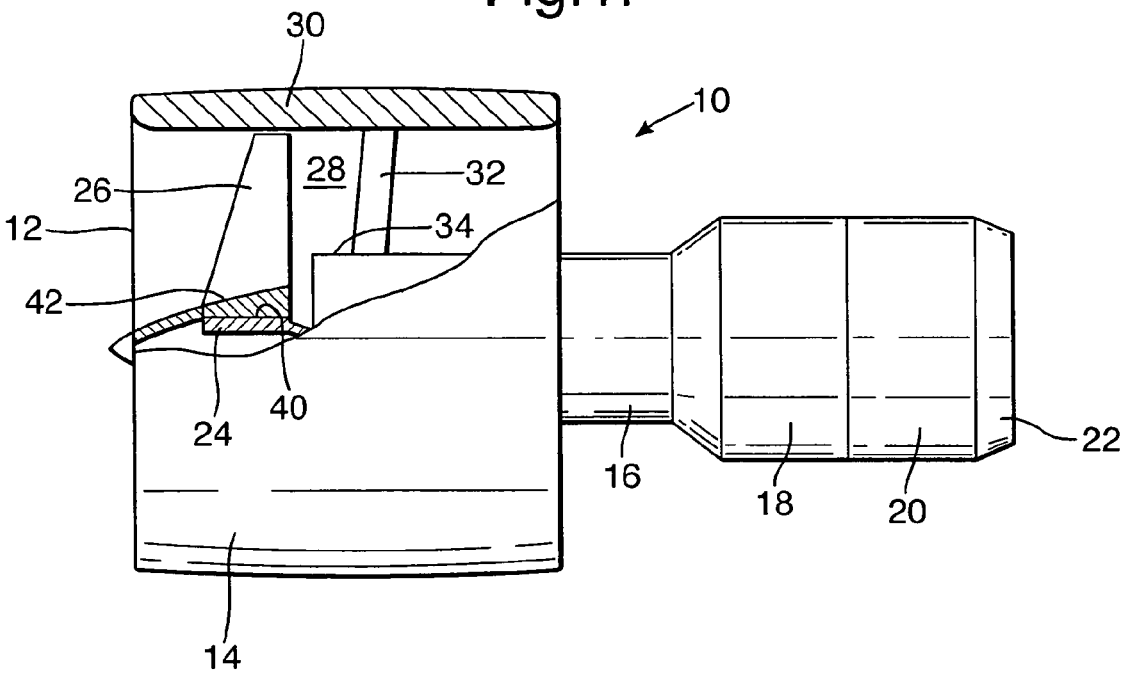
FIG. 1 shows a turbofan gas turbine engine having a fan blade according to the present invention.
Figure 2:
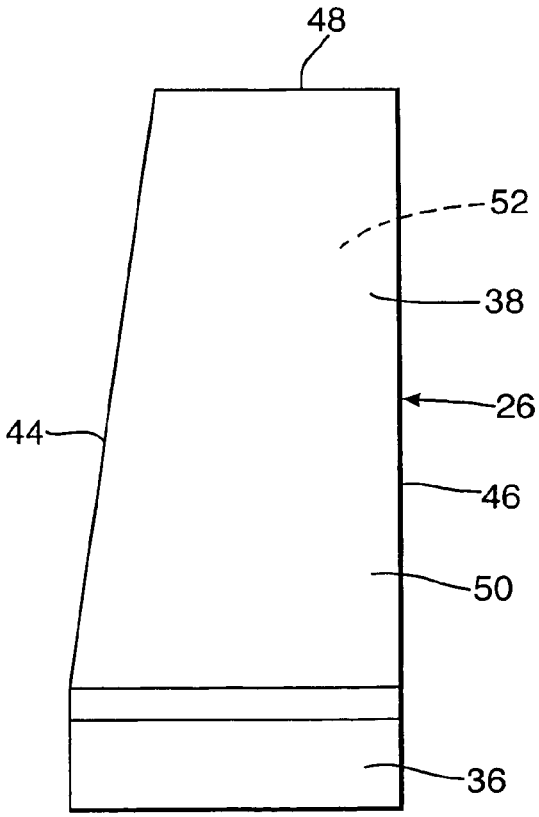
FIG. 2 shows a fan blade according to the present invention.
Figure 3:
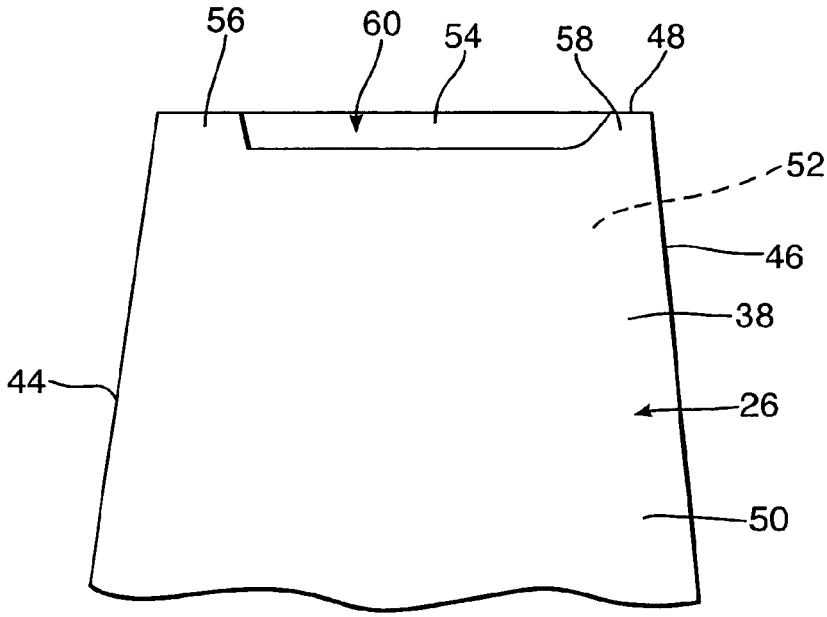
FIG. 3 shows an enlarged view of a tip of the fan blade shown in FIG. 2.
Figure 4:
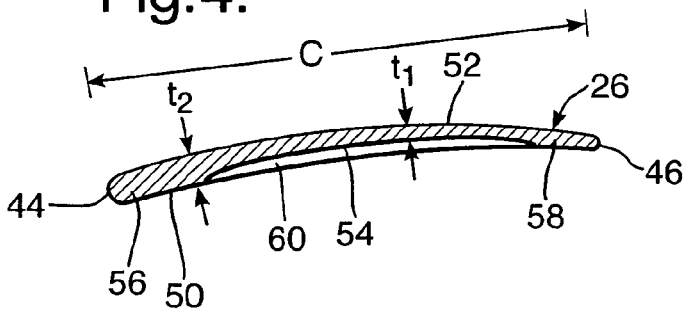
FIG. 4 shows a cross-sectional view through the tip of the fan blade shown in FIG. 3.
Figure 5:
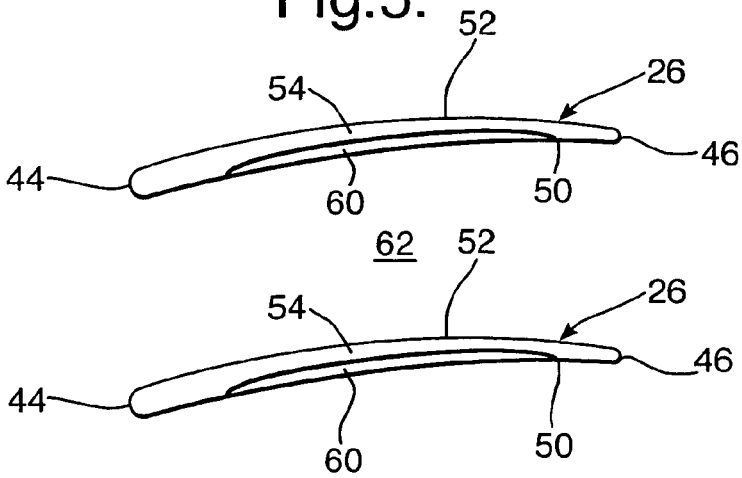
FIG. 5 shows a view of the tips of two adjacent fan blades according to the present invention.

A turbofan gas turbine engine 10, as shown in FIG. 1, comprises in flow series an inlet 12, a fan section 14, a compressor section 16, a combustion section 18, a turbine section 20 and an exhaust 22. The fan section 14 comprises a fan rotor 24 carrying a plurality of circumferentially spaced radially outwardly extending fan blades 26. The fan blades 26 are arranged in a bypass duct 28 defined by a fan casing 30, which surrounds the fan rotor 24 and fan blades 26. The fan casing 30 is secured to a core engine casing 34 by a plurality of circumferentially spaced radially extending fan outlet guide vanes 32. The fan rotor 24 and fan blades 26 are arranged to be driven by a turbine (not shown) in the turbine section 20 via a shaft (not shown). The compressor section 16 comprises one or more compressor (not shown) arranged to be driven by one or more turbines (not shown) in the turbine section 20 via respective shafts (not shown).

A fan blade 26 according to the present invention is shown more clearly in FIGS. 2 to 5. The fan blade 26 comprises a root portion 36 and an aerofoil portion 38. The root portion 36 is arranged to locate in a slot 40 in the rim 42 of the fan rotor 24, and for example the root portion 36 may be dovetail shape or firtree shape in cross-section and hence the corresponding slot 40 in the rim 42 of the fan rotor 24 is the same shape. The aerofoil portion 38 has a leading edge 44, a trailing edge 46 and a tip 48 remote from the root portion 36 and the fan rotor 24. A concave pressure surface 50 extends from the leading edge 44 to the trailing edge 46 and a convex suction surface 52 extends from the leading edge 44 to the trailing edge 46.

A portion 54 of the tip 48 of the aerofoil portion 38 between the leading edge 44 and the trailing edge 46 is made thinner than the remainder 56, 58 of the tip 48 of the aerofoil portion 38, for example a portion 56 adjacent the leading edge 44 and a portion 58 adjacent the trailing edge 46. The portion 54 of the tip 48 of the aerofoil portion 38 is thus spaced from the leading edge 44 and the trailing edge 46. In particular the portion 54 of the tip 48 of the aerofoil portion 38 is made thinner by providing a recess 60 in the concave pressure surface 50 at the tip 48 of the aerofoil portion 38.

Preferably the thickness $t_1$ of the portion 54 of the tip 48 of aerofoil portion 38 reduces to a minimum thickness in the range of 60% to 70% of the thickness $t_2$ of the remainder, e.g. portions 56 and 58, of the tip 48 of the aerofoil portion 38. The thickness $t_1$ of the portion 54 of the tip 48 of aerofoil portion 38 reduces to a minimum thickness of 66% of the thickness $t_2$ of the remainder, e.g. portions 56 and 58, of the tip 48 of the aerofoil portion 38.

The concave pressure surface 50 at the portion 54 of the tip 48 blends smoothly with the portions 56 and 58 of the tip 48 of the aerofoil portion 38.

For example the portion 54 of the tip 48 of the aerofoil portion 38 extends from a position at about 50 mm from the leading edge 44 to a position at about 26 mm from the trailing edge 46. The portion 54 of the tip 48 of the aerofoil portion 38 extends about 20 mm from the tip 48 of the aerofoil portion 38 transversely to the chord c, e.g. substantially radially, towards the root portion 36. The fan blade 26 has a chord length at the tip 48 of the aerofoil portion 38 of less than 300 mm.

The portion 54 of the tip 48 of the aerofoil portion 38 is thinner than the remainder of the aerofoil portion 38 radially inwardly thereof. The portion 54 extends radially inwardly by about 6-8% of the chord length at the tip.

The thinning of the tip 48 of the aerofoil portion 38 of the fan blade 26, e.g. the provision of the portion 54 at the tip 48 of the aerofoil portion 38, locally increases the cross-sectional area of a passage 62 defined circumferentially between adjacent fan blades 26 and bounded by the fan casing 30. This results in a reduced local velocity, e.g. Mn. The change in velocity at the tip 48 of the aerofoil portion 38 of the fan blade 26 alters the wavelength, mis-tuning the pressure excitation wave away from approximating to 0.5, 1.5, 2.5 times the length of the passage 62. The passage 62 lengths extend from the leading edge 44 to the trailing edge 46 of the aerofoil portion 38 of the fan blades 26. The non-smooth variation of the cross-sectional area of the passage 62 contributes to additional pressure losses, which attenuate the forward propagating pressure wave.

The concave pressure surface 50 is modified to avoid gross disruption to the convex suction surface 52 and hence to minimise loss of aerodynamic performance of the convex suction surface 52. The concave pressure surface 50 is modified to suit the predicted peak unsteady amplitude of the forward propagating pressure wave and it is modified to avoid compromising aerodynamic or mechanical considerations close to the leading edge 44 and the trailing edge 46 at the tip 48 of the aerofoil portion 38 of the fan blade 26.

The thinning of the tip 48 of the aerofoil portion 38 of the fan blade 26 disrupts the unsteady pressure wave reinforcing the divergent non-integral fan blade vibration at high speed and high altitude operation. This leads to increased life of the fan blade 26 and reduces the possibility of mechanical failure of the fan blade 26 under high altitude cruise conditions.

The present invention is applicable to clapperless fan blades which lead to excitation of other natural modes of vibration, e.g. first flap mode, third flap mode, first torsion mode, second torsion mode or combinations thereof or any of the first ten fundamental vibration modes. The present invention is applicable to metal fan blades and hybrid structured fan blades e.g. composite fan blades. In the case of some designs of hybrid structured fan blades there may be other natural modes of vibration that are not easy to describe using first flap mode, second flap mode, third flap mode, first torsion mode or second torsion mode because the complex structure of these hybrid structured fan blades may distort such mode shapes out of recognition.

I claim:

1. A turbofan gas turbine engine fan blade comprising:

a root portion and an aerofoil portion, the aerofoil portion has a leading edge, a trailing edge and a tip remote from the root portion, a concave pressure surface extends from the leading edge to the trailing edge and a convex suction surface extends from the leading edge to the trailing edge, a portion of the tip of the aerofoil portion between the leading edge and the trailing edge of the aerofoil portion has a recess arranged on the concave pressure surface of the aerofoil portion such that the portion of the tip of the aerofoil portion is thinner than a remainder of the tip, the portion of the tip of the aerofoil portion is spaced from the leading edge and is spaced from the trailing edge, and the turbofan gas turbine engine fan blade being located in a fan section of a turbofan gas turbine engine, wherein a thickness of the portion of the tip of the aerofoil portion reduces to a minimum thickness in the range of 60% to 70% of the thickness of the remainder of the tip.

2. A turbofan gas turbine engine fan blade as claimed in claim 1, wherein the thickness of the portion of the tip of the aerofoil portion reduces to a minimum thickness of 66% of the thickness of the remainder of the tip.

3. A turbofan gas turbine engine fan blade as claimed in claim 1, wherein the portion of the tip of the aerofoil portion extends from a position at about 10% of a chord length from the leading edge to a position at about 90% of the chord length from the leading edge.

4. A turbofan gas turbine engine fan blade as claimed in claim 1, wherein the portion of the tip of the aerofoil portion extends from a position at about 50 mm from the leading edge to a position at about 26 mm from the trailing edge.

5. A turbofan gas turbine engine fan blade as claimed in claim 4, wherein the portion of the tip of the aerofoil portion extends about 20 mm from the tip of the aerofoil portion transversely to the chord.

6. A turbofan gas turbine engine fan blade as claimed in claim 1, wherein the fan blade has a tip chord length of less than 300 mm.

7. A turbofan gas turbine engine fan blade as claimed in claim 1, wherein the portion of the tip blends smoothly with portions of the tip of the aerofoil portion at the leading edge and trailing edge.

8. A turbofan gas turbine engine fan blade as claimed in claim 1, wherein the portion of the tip of the aerofoil portion extends radially inwardly by 6% to 8% of the chord length at the tip of the aerofoil portion.

9. A turbofan gas turbine engine fan rotor arrangement comprising:

a fan rotor and a plurality of circumferentially spaced fan blades extending radially outwardly from the fan rotor, the plurality of circumerentially spaced fan blades being located in a fan section of a turbofan gas turbine engine, each fan blade comprising an aerofoil portion, each aerofoil portion having a leading edge, a trailing edge and a tip remote from the fan rotor, each aerofoil portion having a concave pressure surface extending from the leading edge to the trailing edge and a convex suction surface extending from the leading edge to the trailing edge, a portion of the tip of each aerofoil portion between the leadingedge and the trailing edge of the aerofoil portion has a recess arranged on the concave pressure surface of the aerofoil portion such that the portion of the tip of the aerofoil portion is thinner than a remainder of the tip, the portion of the tip of each aerofoil portion being spaced from the leading edge and being spaced from the trailing edge, a plurality of passages being defined between the fan blades, and a distance between the tips of aerofoil portions of adjacent fan blades increasing from a first distance at the leading edges to a maximum distance at the portions of the tips of each aerofoil portion and decreasing to a second distance at the trailing edges, wherein a thickness of the portion of the tip of each aerofoil portion reduces to a minimum thickness in the range of 60% to 70% of the thickness of the remainder of the tip.

10. A turbofan gas turbine engine fan rotor arrangement as claimed in claim 9, wherein the thickness of the portion of the tip of each aerofoil portion reduces to a minimum thickness of 66% of the thickness of the remainder of the tip.

11. A turbofan gas turbine engine fan rotor arrangement as claimed in claim 9, wherein the portion of the tip of each aerofoil portion extends from a position at about 10% of a chord length from the leading edge to a position at about 90% of the chord length from the leading edge.

12. A turbofan gas turbine engine fan rotor arrangement as claimed in claim 9, wherein the portion of the tip of each aerofoil portion extends from a position at about 50 mm from the leading edge to a position at about 26 mm from the trailing edge.

13. A turbofan gas turbine engine fan rotor arrangement as claimed in claim 12, wherein the portion of the tip of each aerofoil portion extends about 20 mm from the tip of the aerofoil portion transversely to the chord.

14. A turbofan gas turbine engine fan rotor arrangement as claimed in claim 9, wherein the fan blades have a tip chord length of less than 300 mm.

15. A turbofan gas turbine engine fan rotor arrangement as claimed in claim 9, wherein the portion of the tip of each aerofoil portion extends radially inwardly by 6% to 8% of the chord length at the tip of the aerofoil portion.

16. A turbofan gas turbine engine fan blade comprising:

a root portion and an aerofoil portion, the aerofoil portion has a leading edge, a trailing edge and a tip remote from the root portion, a concave pressure surface extends from the leading edge to the trailing edge and a convex suction surface extends from the leading edge to the trailing edge, a portion of the tip of the aerofoil portion between the leading edge and the trailing edge of the aerofoil portion has a recess arranged on the concave pressure surface of the aerofoil portion such that the portion of the tip of the aerofoil portion is thinner than a remainder of the tip, the portion of the tip of the aerofoil portion is spaced from the leading edge and is spaced from the trailing edge, the turbofan gas turbine engine fan blade being located in a fan section of a turbofan gas turbine engine, and the portion of the tip of the aerofoil portion extends from a position at about 10% of a chord length from the leading edge to a position at about 90% of the chord length from the leading edge.

17. A turbofan gas turbine engine fan blade comprising:

a root portion and an aerofoil portion, the aerofoil portion has a leading edge, a trailing edge and a tip remote from the root portion, a concave pressure surface extends from the leading edge to the trailing edge and a convex suction surface extends from the leading edge to the trailing edge, a portion of the tip of the aerofoil portion between the leading edge and the trailing edge of the aerofoil portion has a recess arranged on the concave pressure surface of the aerofoil portion such that the portion of the tip of the aerofoil portion is thinner than a remainder of the tip, the portion of the tip of the aerofoil portion is spaced from the leading edge and is spaced from the trailing edge, the turbofan gas turbine engine fan blade being located in a fan section of a turbofan gas turbine engine, the portion of the tip of the aerofoil portion extends from a position at about 10% of a chord length from the leading edge to a position at about 90% of the chord length from the leading edge, and the portion of the tip of the aerofoil portion extends from a position at about 50 mm from the leading edge to a position at about 50 mm from the trailing edge.

* * * * *